US011671755B2

(12) United States Patent
Chen

(10) Patent No.: US 11,671,755 B2
(45) Date of Patent: *Jun. 6, 2023

(54) MICROPHONE MIXING FOR WIND NOISE REDUCTION

(71) Applicant: Cirrus Logic International Semiconductor Ltd., Edinburgh (GB)

(72) Inventor: Henry Chen, Cremorne (AU)

(73) Assignee: Cirrus Logic, Inc., Austin, TX (US)

( * ) Notice: Subject to any disclaimer, the term of this patent is extended or adjusted under 35 U.S.C. 154(b) by 200 days.

This patent is subject to a terminal disclaimer.

(21) Appl. No.: 16/112,365

(22) Filed: Aug. 24, 2018

(65) Prior Publication Data

US 2018/0367896 A1 Dec. 20, 2018

Related U.S. Application Data

(63) Continuation of application No. 15/312,874, filed as application No. PCT/AU2015/050278 on May 26, 2015, now Pat. No. 10,091,579.

(30) Foreign Application Priority Data

May 29, 2014 (AU) ..... 2014902057

(51) Int. Cl.

| | |
|---|---|
| ***H04R 3/00*** | (2006.01) |
| ***H04R 1/40*** | (2006.01) |
| *H04R 5/04* | (2006.01) |

(52) U.S. Cl.

CPC ..... *H04R 3/005* (2013.01); *H04R 1/406* (2013.01); *H04R 5/04* (2013.01);

(Continued)

(58) Field of Classification Search

CPC combination set(s) only.

See application file for complete search history.

(56) References Cited

U.S. PATENT DOCUMENTS 5,384,843 A 1/1995 Masuda et al.
5,463,694 A 10/1995 Bradley et al.

(Continued)

FOREIGN PATENT DOCUMENTS

AU WO-2013091021 A1 * 6/2013 ..... H04R 3/002
GB 2484722 A 4/2012

(Continued)

OTHER PUBLICATIONS

International Search Report and Written Opinion of the International Searching Authority, International Application No. PCT/AU2015/050278, dated Sep. 10, 2015.

(Continued)

*Primary Examiner* — Duc Nguyen
*Assistant Examiner* — Assad Mohammed
(74) *Attorney, Agent, or Firm* — Jackson Walker L.L.P.

(57) ABSTRACT

Wind noise reduction in microphone signals. A first microphone signal is obtained from a first omnidirectional microphone and, contemporaneously, a second microphone signal is obtained from a second omnidirectional microphone. The first and second microphone signals are mixed to produce an output signal. Mixing involves weighting the first and second microphone signals by respective first and second signal weights to produce respective first and second weighted microphone signals, and summing the first and second weighted microphone signals together to produce the output signal. The first and second signal weights are calculated to minimize the power of the output signal.

16 Claims, 4 Drawing Sheets

(52) U.S. Cl.
CPC .... *H04R 2201/405* (2013.01); *H04R 2410/07* (2013.01); *H04R 2430/03* (2013.01); *H04R 2499/11* (2013.01)

(56) References Cited

U.S. PATENT DOCUMENTS

| | | | | |
|---|---|---|---|---|
| 5,602,962 | A | 2/1997 | Kellermann | |
| 5,627,799 | A | 5/1997 | Hoshuyama | |
| 6,272,229 | B1 * | 8/2001 | Baekgaard | H04R 25/407 381/312 |
| 6,405,163 | B1 | 6/2002 | Laroche | |
| 6,751,325 | B1 | 6/2004 | Fischer | |
| 6,859,420 | B1 | 2/2005 | Coney et al. | |
| 7,076,072 | B2 | 7/2006 | Feng et al. | |
| 7,120,262 | B2 | 10/2006 | Klinke | |
| 7,171,008 | B2 * | 1/2007 | Elko | H04R 3/005 381/122 |
| 7,324,649 | B1 | 1/2008 | Knapp et al. | |
| 7,471,798 | B2 | 12/2008 | Warren | |
| 8,331,582 | B2 | 12/2012 | Steele | |
| 8,411,880 | B2 | 4/2013 | Wang et al. | |
| 2005/0244018 | A1 * | 11/2005 | Fischer | H04R 29/006 381/92 |
| 2007/0014419 | A1 * | 1/2007 | Steele | H04R 3/005 381/92 |
| 2008/0049953 | A1 * | 2/2008 | Harney | H04R 1/245 381/94.7 |
| 2009/0141907 | A1 | 6/2009 | Kim et al. | |
| 2009/0175466 | A1 * | 7/2009 | Elko | H04R 25/407 381/94.1 |
| 2009/0238377 | A1 | 9/2009 | Ramakrishnan et al. | |
| 2012/0123771 | A1 | 5/2012 | Chen et al. | |
| 2012/0128163 | A1 * | 5/2012 | Moerkebjerg | H04R 25/407 381/23.1 |
| 2012/0243695 | A1 | 9/2012 | Sohn et al. | |
| 2014/0161271 | A1 * | 6/2014 | Teranishi | H04R 5/04 381/71.7 |

FOREIGN PATENT DOCUMENTS

| | | | | |
|---|---|---|---|---|
| WO | 2013091021 | A1 | 6/2013 | |
| WO | WO-2013091021 | A1 * | 6/2013 | H04R 3/002 |

OTHER PUBLICATIONS

Chung, King, PHD, Challenges and Recent Developments in Hearing Aids, Part I. Speech Understanding in Noise, Microphone Technologies and Noise Reduction Algorithms, Trends in Amplification, vol. 8, No. 3, p. 93, cols. 1 & 2, Department of Speech, Language and Hearing Sciences, Purdue University, West Lafayette, IN, Westminster Publications, Inc., Glen Head, NY, 2004.

* cited by examiner

MICROPHONE MIXING FOR WIND NOISE REDUCTION

CROSS-REFERENCE TO RELATED APPLICATIONS

This application is a continuation of U.S. patent application Ser. No. 15/312,874, filed Nov. 21, 2016, which is a 371 of International Patent Application Serial No. PCT/AU2015/050278, which claims the benefit of Australian Provisional Patent Application No. 2014902057 filed May 29, 2014; the entirety of which are all incorporated herein by reference.

TECHNICAL FIELD

The present invention relates to the digital processing of signals from microphones or other such transducers, and in particular relates to a device and method for mixing multiple such signals in order to reduce wind noise.

BACKGROUND OF THE INVENTION

Processing signals from microphones in consumer electronic devices such as smartphones, hearing aids, headsets and the like presents a range of design problems. There are usually multiple microphones to consider, including one or more microphones on the body of the device and one or more external microphones such as headset or hands-free car kit microphones. In smartphones these microphones can be used not only to capture speech for phone calls, but also for recording voice notes. In the case of devices with a camera, one or more microphones may be used to enable recording of an audio track to accompany video captured by the camera. Increasingly, more than one microphone is being provided on the body of the device, for example to improve noise cancellation as is addressed in GB2484722 (Wolfson Microelectronics).

The device hardware associated with the microphones should provide for sufficient microphone inputs, preferably with individually adjustable gains, and flexible internal routing to cover all usage scenarios, which can be numerous in the case of a smartphone with an applications processor. Telephony functions should include a "side tone" so that the user can hear their own voice, and acoustic echo cancellation. Jack insertion detection should be provided to enable seamless switching between internal to external microphones when a headset or external microphone is plugged in or disconnected.

Consequently, a range of digital signal processing applications involve the mixing of signals from multiple microphones, whether across the full audio band or in selected frequency subbands. Adaptive directional beamforming is one such application, and involves the signals from two or more microphones being mixed in a manner to maintain gain in a direction of interest (typically being the forward direction of the listener), while adaptively nulling background noise from other directions, such as conversations happening behind the listener. Adaptive directional beamforming works to null signals coming from a particular direction such as background speech, and in particular this approach only works on such correlated signals.

However wind noise detection and reduction is a particularly difficult problem in such devices. Wind noise is defined herein as a microphone signal generated from turbulence in an air stream flowing past microphone ports, as opposed to the sound of wind blowing past other objects such as the sound of rustling leaves as wind blows past a tree in the far field. Wind noise can be objectionable to the user, can mask other signals of interest, and can corrupt the device's ability to suppress background noise sources by beamforming. It is desirable that digital signal processing devices are configured to take steps to ameliorate the deleterious effects of wind noise upon signal quality. However, when wind noise is present, existing devices simply revert adaptive directional beamforming to an omnidirectional state by use of a primary microphone only. This is because the beamforming function cannot identify and thus cannot null a direction of origin of wind noise because wind noise is uncorrelated between microphones. Instead, disadvantageously, beamforming functions are usually corrupted by wind noise and respond inappropriately by actually amplifying uncorrelated noise such as wind noise. It is for this reason that existing devices tend to simply disable beamforming in the presence of wind noise and revert to a primary microphone and omnidirectional operation.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

In this specification, a statement that an element may be "at least one of" a list of options is to be understood that the element may be any one of the listed options, or may be any combination of two or more of the listed options.

SUMMARY OF THE INVENTION

According to a first aspect the present invention provides a method of wind noise reduction, the method comprising:

- obtaining a first microphone signal from a first omnidirectional microphone;
- contemporaneously obtaining a second microphone signal from a second omnidirectional microphone; and
- mixing the first and second microphone signals to produce an output signal, by:
  - weighting the first and second microphone signals by respective first and second signal weights to produce respective first and second weighted microphone signals; and
  - summing the first and second weighted microphone signals together to produce the output signal,
- wherein the first and second signal weights are calculated to minimize the power of the output signal.

According to a second aspect the present invention provides a device for wind noise reduction, the device comprising:

- a first omnidirectional microphone and a second omnidirectional microphone;
- a processor for calculating first and second signal weights in a manner to minimize the power of an output signal;
- a first multiplication block configured to apply the first signal weight to a first microphone signal from the first omnidirectional microphone, and a second multiplication block configured to apply the second signal weight to a second microphone signal from the second omnidirectional microphone; and a summation block configured to sum the weighted first and second microphone signals together to produce the output signal.

In some embodiments, the first signal weight may be denoted by a, wherein a takes a value in the range of 0 to 1, inclusive. In such embodiments, the second signal weight may be defined to be (1−a). The first signal weight may be calculated by the processor as follows:

$$a = \frac{\sum y^2 - \sum xy}{\sum x^2 - 2\sum xy + \sum y^2} \tag{1}$$

where:

x=signal sample of the first microphone signal, and y=signal sample of the second microphone signal.

Alternative embodiments may apply equation (1) in a modified form for example with scalar coefficients not equal to 1 applied to any one or more of the terms.

A weight may be calculated for a frame of predetermined length consisting of N first signal samples and N second signal samples. The length of the frame (N) generally depends upon the environment of application of the method, however a suitable frame length for audio frequency signals is 32 or 64 samples long. The weighting factor calculated by use of equation (1) alone may change significantly from frame to frame, so in some preferred embodiments the series of weight values determined for a may be filtered or smoothed to minimize frame to frame variation in the weight which may otherwise be heard as audible artifacts.

In another embodiment weights are calculated continuously for each first signal sample and second signal sample. This is achieved by calculating $x^2$, $y^2$ and xy for each sample and adding them to a respective appropriate running sum. A leaky integrator (an integrator having a feedback coefficient slightly less than one) can be used to perform the running sum in order to prevent overflows and to ensure that the system's 'memory' is not too long. Such embodiments allow a new weighting factor to be calculated every time that a new sample is available, rather than having to wait for a whole frame of samples.

In another embodiment, the first and second signals (i.e. the variables x and y in the form described above) can be frequency domain samples rather than time domain samples. In this case the optimization of the weighting factor $a_i$ can be calculated as above for each subband i, but with the added advantage that the weighting factor can be calculated and applied on a subband-by-subband basis, giving different mixing ratios at different frequencies. Also, if some frequencies are deemed to be more important for wind noise suppression than other frequencies, they can be given a higher weighting, for example by calculating the weighting factor a in respect of such frequencies before applying a for mixing across the entire audio band, and/or by performing mixing only in the important subbands. In embodiments utilizing complex inputs such as those in the DFT domain, the weighting factor may be calculated as being:

$$a = \frac{\sum |y|^2 - \mathrm{real}(\sum x * \bar{y})}{\sum |x|^2 - 2 * \mathrm{real}(\sum x * \bar{y}) + \sum |y|^2}$$

where $\bar{y}$ is the complex conjugate of y, |y| is the absolute value of y and real( ) is a function that takes the real part of the complex input.

The present invention is also applicable to signals produced from more than two microphones. In such embodiments, the processor is configured to calculate the required number of signal weights in a manner to minimize the power of the output signal. For example, when a signal z from a third omnidirectional microphone is obtained, the output signal Y may be calculated as follows:

$$Y = a*\text{primary_mic} + b*\text{secondary_mic} + (1-a-b)*\text{tertiary_mic}$$

where $$a = \frac{(\sum x^2)^{-1}}{(\sum x^2)^{-1} + (\sum y^2)^{-1} + (\sum z^2)^{-1}}, \text{ and}$$

$$b = \frac{(\sum y^2)^{-1}}{(\sum x^2)^{-1} + (\sum y^2)^{-1} + +(\sum z^2)^{-1}}.$$

Other embodiments of the present invention may mix four or more microphone signals in a corresponding manner.

In some embodiments, prior to mixing, the first and second microphone signals are matched for a level of a signal of interest, such as speech. In some embodiments, prior to mixing, the first and second microphone signals may be matched for phase.

In some embodiments the method of the present invention may be activated only at times when a wind noise detector indicates that wind noise is present. The wind noise detector may be implemented in the manner set out in International Patent Application No. PCT/AU2012/001596 by Wolfson Dynamic Hearing Pty Ltd, published as WO2013/091021, the content of which is incorporated herein by reference. The method of the present invention may in some embodiments be discontinued at times when a wind noise detector indicates that wind noise is not present.

In some embodiments involving stereo audio channels, the method of the present invention may be utilized to produce from a plurality of left-side microphones a wind-noise-reduced left side output signal, and may further be utilized to produce from a plurality of right-side microphones a wind-noise-reduced right side output signal. The wind-noise-reduced left and right side signals may then be used for further stereo processing. The present invention may similarly be applied in multi-channel environments such as 5:1 surround sound environments to produce a wind-noise-reduced signal for each channel.

BRIEF DESCRIPTION OF THE DRAWINGS

An example of the invention will now be described with reference to the accompanying drawings, in which.

DESCRIPTION OF THE PREFERRED EMBODIMENTS

Figure 1:
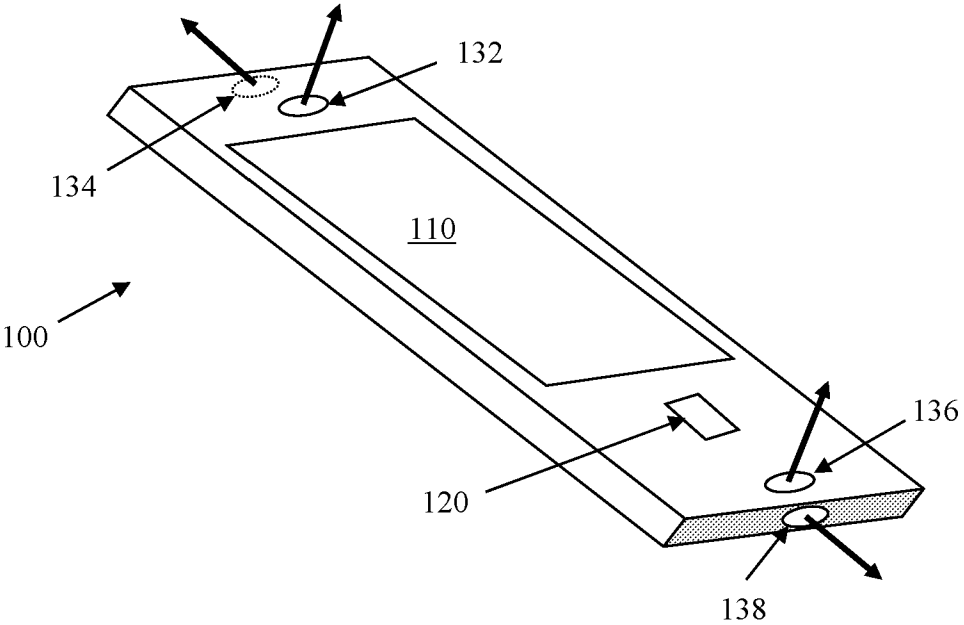
FIG. 1 illustrates the layout of microphones of a handheld device in accordance with one embodiment of the invention.

FIG. 1 illustrates a handheld smartphone device 100 with touchscreen 110, button 120 and microphones 132, 134, 136, 138. The following embodiments describe the capture of audio using such a device, for example to accompany a video recorded by a camera (not shown) of the device or for use as a captured speech signal during a telephone call. Microphone 132 captures a first microphone signal, and microphone 134 captures a second microphone signal. Microphone 132 is mounted in a port on a front face of the device 100, while microphone 134 is mounted in a part on an end face of the device 100. Thus, the port configuration will give microphones 132 and 134 differing susceptibility to wind noise, based on the small scale device topography around each port and the resulting different effects in airflow past each respective port. Consequently, the signal captured by microphone 132 will suffer from wind noise in a different manner to the signal captured by microphone 134.

Figure 2:
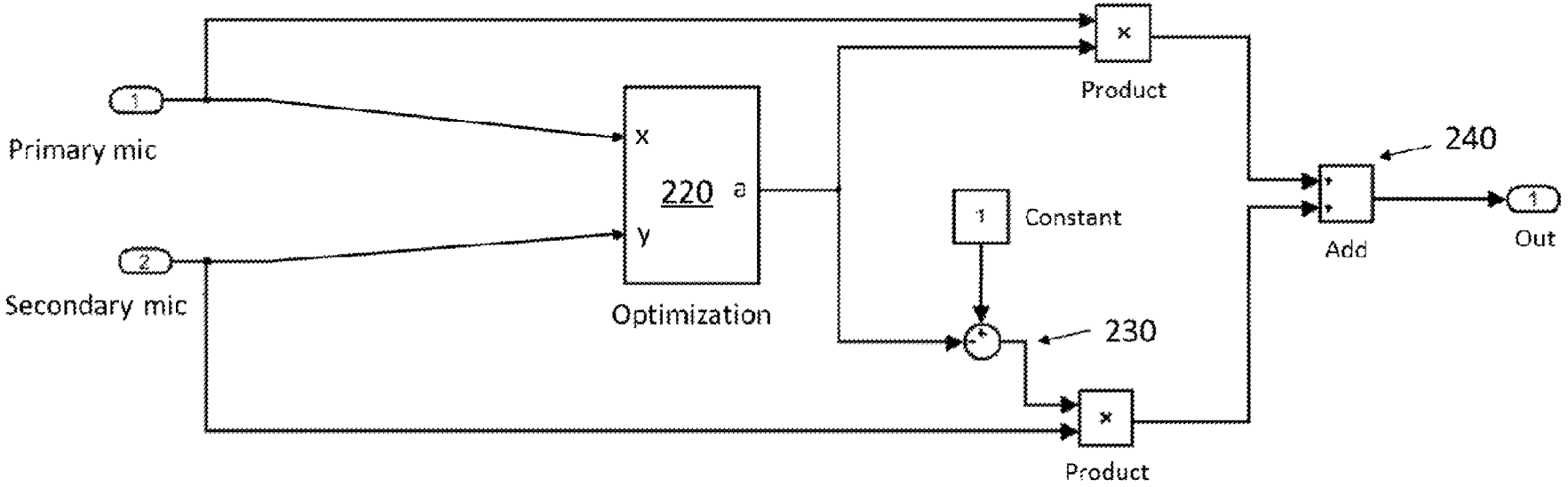
FIG. 2 is a schematic illustration of signal mixing for wind noise reduction in accordance with one embodiment of the invention.

FIG. 2 illustrates the manner in which the signals from microphones 132 and 134 are mixed in order to produce an output signal carrying reduced wind noise. The signals from the first and second microphones are passed to an optimization block 220. Block 220 calculates a weight a, and at 230 a value (1−a) is produced, which are the respective weights applied to the first and second microphone signals before producing the output signal at 240.

In the present embodiment, the weight a is calculated by block 220 as follows:

$$a = \frac{\sum y^2 - \sum xy}{\sum x^2 - 2\sum xy + \sum y^2}$$

where:

x=signal sample of the first microphone signal, and y=signal sample of the second microphone signal.

The derivation of the above formula is found by using the constraint that the total power of the output wind-noise-reduced signal is to be minimized. It is noted that:

$$\text{Energy}=\Sigma(ax(t)+(1-a)y(t))^2$$

Thus, differentiating with respect to a to find the point of minimum energy gives:

$$\frac{dEnergy}{da} = 0$$
$$= 2a\left(\sum x^2 - 2\sum xy + \sum y^2\right) + 2\left(\sum xy - \sum y^2\right)$$

Solving for a gives:

$$a = \frac{\sum y^2 - \sum xy}{\sum x^2 - 2\sum xy + \sum y^2}$$

To implement this requirement, the primary mic and secondary mic signals are buffered and the buffer signals are used as the inputs to the optimization algorithm. The algorithm outputs the mixing coefficient 'a' within a range of 0 and 1, inclusive. The value of a is then smoothed with a leaky integrator and constrained to the range between 0 and 1, inclusive.

The output signal produced at 240 is thus:

$$\text{output}=a*\text{primary_mic}+(1-a)*\text{secondary_mic}$$

If we assume the microphone signals are not correlated in wind, the equation can be simplified as $$a = \frac{\left(\sum x^2\right)^{-1}}{(\sum x^2)^{-1} + (\sum y^2)^{-1}}.$$

However this simplified equation is less optimal if speech is present during wind.

The present invention can in other embodiments be extended to producing a wind-noise-reduced output from 3 or more microphone inputs. For three microphones, where z is the input from the tertiary microphone:

$$Y=a*\text{primary_mic}+b*\text{secondary_mic}+(1-a-b)*\text{tertiary_mic}$$

In one embodiment for reducing wind noise, involving the use of three input microphone signals:

$$a = \frac{\left(\sum x^2\right)^{-1}}{(\sum x^2)^{-1} + (\sum y^2)^{-1} + (\sum z^2)^{-1}}, \text{ and}$$

$$b = \frac{\left(\sum y^2\right)^{-1}}{(\sum x^2)^{-1} + (\sum y^2)^{-1} + +(\sum z^2)^{-1}}.$$

In another embodiment for reducing wind noise, involving the use of three input microphone signals, the primary mic input and secondary mic input are mixed using equation (1) to determine a mixing factor A. Next, the mixed result produced by applying A and (1−A) weights to the primary and secondary signals is processed together with the tertiary input, to determine a mixing factor B. The mixing coefficient is then calculated as a=A*B and b=(1−A)*B.

Figure 3:
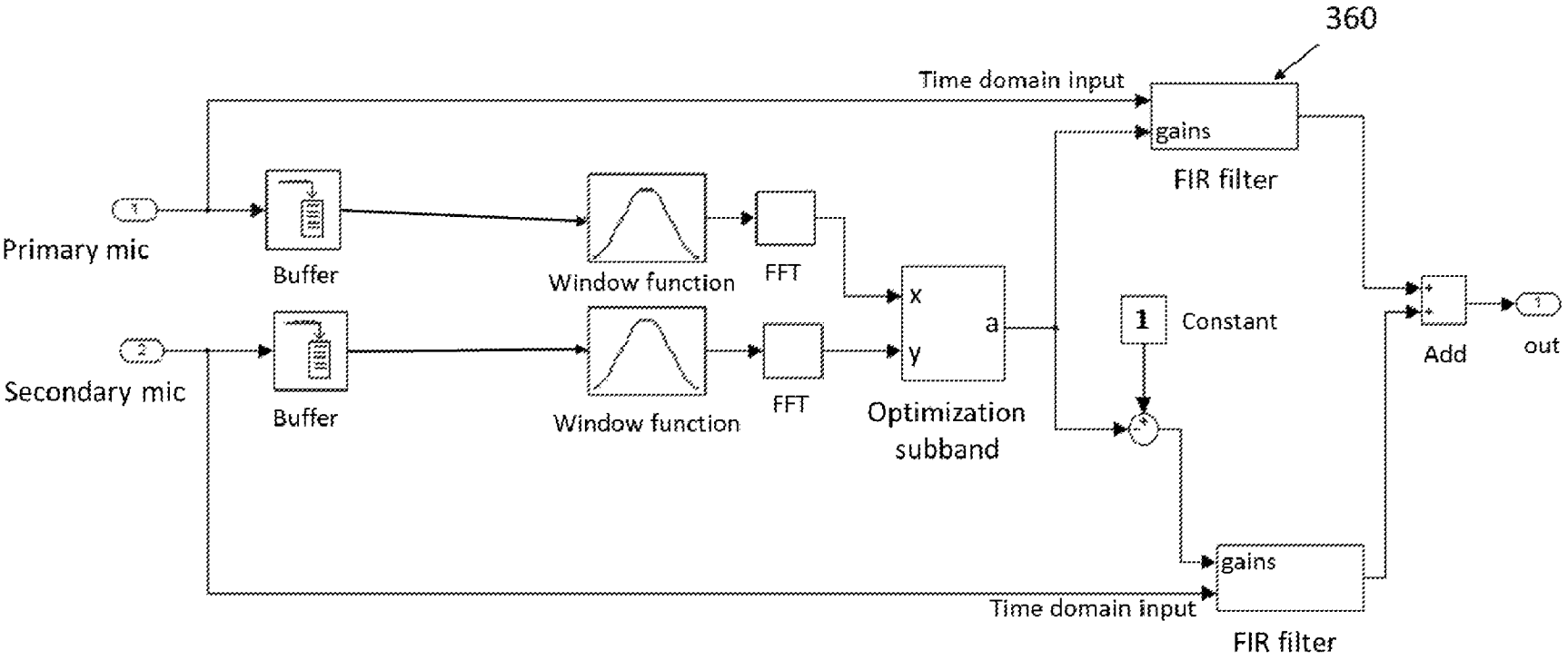
FIG. 3 is a schematic illustration of sub-band signal mixing for wind noise reduction in accordance with another embodiment of the invention.

FIG. 3 illustrates an embodiment in which the mixing procedure is performed in subbands. In subband processing, the mixing coefficient '$a_i$' is calculated in each subband i. For complex inputs (for example, in the DFT domain):

$$a = \frac{\sum |y|^2 - \text{real}\left(\sum x * \bar{y}\right)}{\sum |x|^2 - 2 * \text{real}(\sum x * \bar{y}) + \sum |y|^2},$$

where $\bar{y}$ is the complex conjugate of y, |y| is the absolute value of y and real( ) is a function that takes the real part of the complex input.

The FIR filter 360 can be built from an inverse DFT of the array of the '$a_i$' values.

While the preceding describes the mixing of the signals from microphones 132 and 134 in order to produce a first wind-noise-reduced signal, it is to be noted that the signals from microphones 136 and 138 may also be similarly mixed in accordance with the present invention in order to produce a second wind-noise-reduced signal. Microphone 136 captures a first (primary) right signal $R_1$, and microphone 138 captures a second (secondary) right signal $R_2$. The first and second wind-noise-reduced signals may then be processed by subsequent stages as desired, and for example could be input to an adaptive directional microphone stage, or could be used for stereo processing to retain binaural cues, or could be used for other multi-channel audio functions as appropriate.

Figure 4:
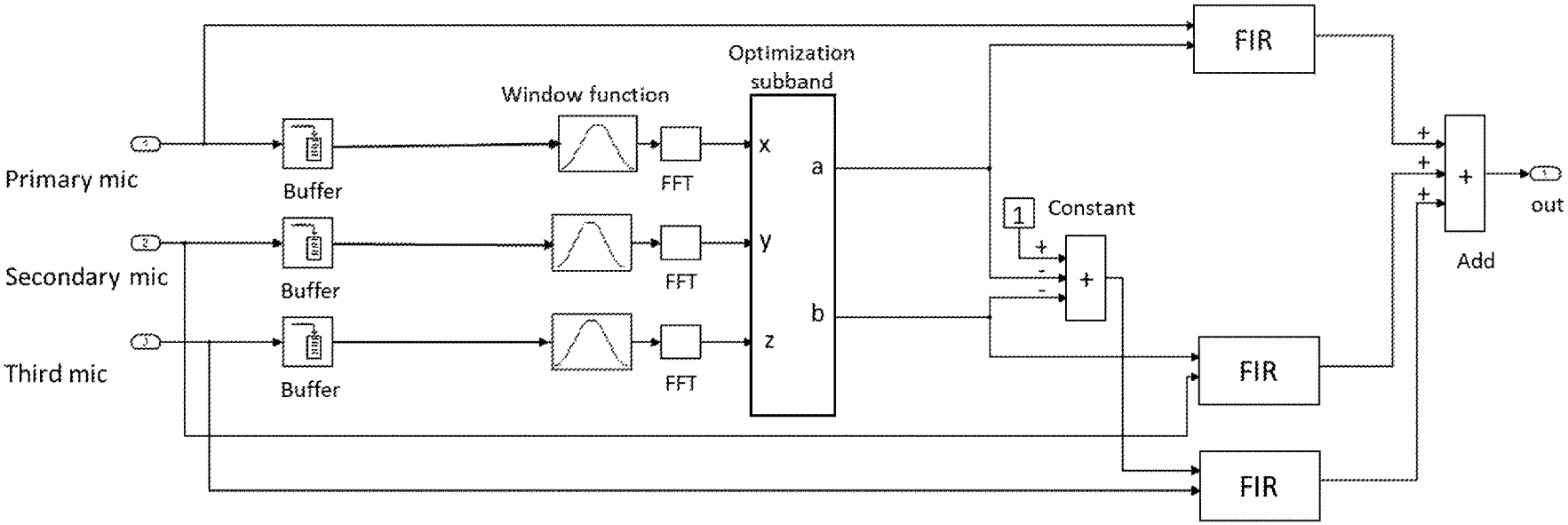
FIG. 4 illustrates another embodiment in which the mixing procedure is performed in respect of three microphones, in subbands.

FIG. 4 illustrates an embodiment in which the mixing procedure is performed in respect of three microphones, in subbands. In this embodiment the third input is a beamforming output produced in a preceding stage (not shown) by using the signals from the primary mic and secondary mic. This arrangement is particularly advantageous because wind tends to dominate in the low frequency, and so in the low frequency bands the wind noise power is reduced by the mixing procedure of the present invention. In the other, higher, frequency bands where there is less wind noise impact, the beamforming reduces environmental noise. Thus in the high frequency bands the mixing procedure will weight strongly towards the beamforming output. In this scenario, both wind noise and environmental noise from certain directions will be reduced. In other embodiments the third input could simply be from another microphone or another signal processing stage, as appropriate.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not limiting or restrictive.

The invention claimed is:

1. A method of wind noise reduction, the method comprising:

obtaining, by a processor, a first microphone signal from a first omnidirectional microphone;

contemporaneously obtaining, by the processor, a second microphone signal from a second omnidirectional microphone, at least one of the first and second microphone signals comprising wind noise;

prior to mixing the first and second microphone signals, matching the first and second microphone signals for (i) a level of a signal of interest or (ii) phase; and mixing the matched first and second microphone signals to produce an output signal, by:

calculating first and second signal weights to minimise the power of the output signal, wherein the first and second signals are frequency domain samples, wherein the first and second signal weights comprise a weighting factor a calculated for each subband i, and wherein the weighting factors a; are applied on a subband-by-subband basis to give different mixing ratios at different frequencies;

applying the weighting factors $a_i$ to the first microphone signal on a subband-by-subband basis to produce a first weighted microphone signal;

applying the weighting factors $a_i$ to the second microphone signal on a subband-by-subband basis to produce a second weighted microphone signal; and summing the first and second weighted microphone signals together to produce the output signal.

2. The method of claim 1, wherein the first signal weight a takes a value in the range of 0 to 1 inclusive, and is calculated by the processor as follows:

$$a = \frac{\sum y^2 - \sum xy}{\sum x^2 - 2\sum xy + \sum y^2} \quad (1)$$

where:

x=signal sample of the first microphone signal, and y=signal sample of the second microphone signal, and wherein the second signal weight is (1−a).

3. The method of claim 1 wherein weights are calculated continuously for each first signal sample and second signal sample, by calculating $x^2$, $y^2$ and xy for each sample and adding them to a respective appropriate running sum.

4. The method of claim 3 wherein a leaky integrator is used to perform the running sum in order to prevent overflows.

5. The method of claim 1 wherein frequencies deemed to be more important for wind noise suppression are given a higher weighting.

6. The method of claim 5 wherein the frequencies deemed to be more important are given a higher weighting by calculating the weighting factor a in respect of such frequencies before applying a for mixing across a wider band.

7. The method of claim 5 wherein the frequencies deemed to be more important are given a higher weighting by performing mixing only in the important subbands.

8. The method of claim 1 wherein complex inputs are utilised and the weighting factor is calculated as being:

$$a = \frac{\sum |y|^2 - \text{real}\left(\sum x * \bar{y}\right)}{\sum |x|^2 - 2 * \text{real}(\sum x * \bar{y}) + \sum |y|^2}$$

where $\bar{y}$ is the complex conjugate of y, |y| is the absolute value of y and real( ) is a function that takes the real part of the complex input.

9. The method of claim 1 when applied to signals produced from more than two microphones.

10. The method of claim 9 wherein the processor is configured to calculate the required number of signal weights in a manner to minimise the power of the output signal.

11. The method of claim 10 wherein, when a signal z from a third omnidirectional microphone is obtained, the output signal Y is calculated as follows:

$$Y = a*\text{primary_mic} + b*\text{secondary_mic} + (1-a-b)*\text{tertiary_mic}$$

where $$a = \frac{\left(\sum x^2\right)^{-1}}{(\sum x^2)^{-1} + (\sum y^2)^{-1} + (\sum z^2)^{-1}}, \text{ and}$$

$$b = \frac{\left(\sum y^2\right)^{-1}}{(\sum x^2)^{-1} + (\sum y^2)^{-1} + +(\sum z^2)^{-1}}.$$

12. The method of claim 1 further comprising activating the wind noise reduction only at times when a wind noise detector indicates that wind noise is present.

13. The method of claim 1 when utilised to produce from a plurality of left-side microphones a wind-noise-reduced left side output signal, and to produce from a plurality of right-side microphones a wind-noise-reduced right side output signal.

14. A device for wind noise reduction, the device comprising:

a first omnidirectional microphone and a second omnidirectional microphone;

a processor for:

calculating first and second signal weights in a manner to minimise the power of an output signal, wherein the first and second signals are frequency domain samples, wherein the first and second signal weights comprise a weighting factor a calculated for each subband i, and wherein the weighting factors $a_i$ are applied on a subband-by-subband basis to give different mixing ratios at different frequencies; and prior to mixing the first and second microphone signals, matching the first and second microphone signals for (i) a level of a signal of interest or (ii) phase;

a first multiplication block configured to apply the weighting factors $a_i$ to a first microphone signal from the first omnidirectional microphone on a subband-by-subband basis to produce a weighted first microphone signal;

a second multiplication block configured to apply the weighting factors $a_i$ to a second microphone signal from the second omnidirectional microphone on a subband-by-subband basis to produce a weighted second microphone signal;

wherein at least one of the first and second signals comprise wind noise; and a summation block configured to sum the matched weighted first and second microphone signals together to produce the output signal.

15. The device of claim 14 wherein the first and second signals are frequency domain samples, and wherein the processor is configured to calculate a weighting factor $a_i$ for each subband i, and to apply the $a_i$ on a subband-by-subband basis to give different mixing ratios at different frequencies, and wherein the processor is configured to give a higher weighting to frequencies deemed to be more important for wind noise suppression.

16. The device of claim 14 further comprising a third omnidirectional microphone, and wherein the processor is configured to calculate a third signal weight in a manner that the first to third signal weights when applied to the respective signals minimise the power of an output signal Y which is calculated by the processor as follows:

$$Y=a*\text{primary_mic}+b*\text{secondary_mic}+(1-a-b)*\text{tertiary_mic}_{where}$$

$$a=\frac{\left(\sum x^2\right)^{-1}}{(\sum x^2)^{-1}+(\sum y^2)^{-1}+(\sum z^2)^{-1}},\text{ and}$$

$$b=\frac{\left(\sum y^2\right)^{-1}}{(\sum x^2)^{-1}+(\sum y^2)^{-1}++(\sum z^2)^{-1}}.$$

and where x=signal sample of the first microphone signal, y=signal sample of the second microphone signal; and z=signal sample of the third microphone signal.

* * * * *